US006952551B2

(12) United States Patent
Koyanagi et al.

(10) Patent No.: US 6,952,551 B2
(45) Date of Patent: Oct. 4, 2005

(54) DEVELOPER CARRYING MEMBER AND DEVELOPING APPARATUS

(75) Inventors: Masato Koyanagi, Shizuoka (JP); Yasuyuki Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 10/693,859

(22) Filed: Oct. 28, 2003

(65) Prior Publication Data

US 2004/0240910 A1 Dec. 2, 2004

(30) Foreign Application Priority Data

Oct. 30, 2002 (JP) ..... 2002-316896
Oct. 20, 2003 (JP) ..... 2003-359898

(51) Int. Cl.[7] ..... G03G 15/08
(52) U.S. Cl. ..... 399/286
(58) Field of Search ..... 399/286, 279, 399/265; 492/30, 59

(56) References Cited

U.S. PATENT DOCUMENTS 3,863,603 A * 2/1975 Buckley et al. ..... 399/279
5,177,538 A * 1/1993 Mammino et al. ..... 399/265
5,286,917 A * 2/1994 Unno et al. ..... 399/279
5,741,616 A * 4/1998 Hirano et al. ..... 399/286
6,360,069 B1 * 3/2002 Mimura et al. ..... 399/286
6,430,384 B2 * 8/2002 Hama et al.
6,574,444 B2 6/2003 Uehara et al. ..... 399/103
6,594,462 B2 7/2003 Ishii et al. ..... 399/281
6,841,327 B2 * 1/2005 Otake et al.

FOREIGN PATENT DOCUMENTS

JP 4-88382 3/1992

* cited by examiner

*Primary Examiner*—Susan Lee
(74) *Attorney, Agent, or Firm*—Fitzpatrick, Cella, Harper & Scinto

(57) ABSTRACT

The invention provides a developer carrying member for carrying a developer for developing an electrostatic image formed on an image bearing member, including an elastic layer, and a surface layer provided on a surface of the developer carrying member and including a resin and particles, wherein the particles have a property of being frictionally charged in a polarity opposite to a normal charging polarity of the developer, and the particles are exposed from the surface in an area rate within a range from 15 to 60% with respect to a surface area of the developer carrying member. In this manner, an uneven heating of the toner image can be suppressed even if the recording material generates an undulation after passing a nip.

20 Claims, 10 Drawing Sheets

DEVELOPER CARRYING MEMBER AND DEVELOPING APPARATUS

BACKGROUND OF THE INVENTION

1. Field of the Invention

The present invention relates to a developer carrying member for developing an electrostatic image on an image bearing member, and a developing apparatus provided with such member. Such developer carrying member and developing apparatus are advantageously employed in an image forming apparatus such as a copying apparatus or a printer utilizing an electrophotographic process or an electrostatic recording process, and in a process cartridge detachably attachable on such apparatus.

2. Related Background Art

FIG. 9 is a schematic view showing a typical example of an image forming apparatus. The image forming apparatus of this example is a copying apparatus or a printer utilizing an electrophotographic process of transfer type.

A drum-shaped electrophotographic photosensitive member 1 (hereinafter referred to as "photosensitive drum") is provided as an image bearing member and is rotated in a direction R1 with a predetermined peripheral speed (process speed), and image forming process including charging, image exposure, development, transfer and cleaning is applied to the photosensitive drum 1.

More specifically, a surface of the rotated photosensitive drum 1 is uniformly charged to a predetermined polarity and a predetermined potential by a primary charger (charging roller) 2. In this example, there will be explained a case of employing a photosensitive drum 1 to be charged negatively.

Then the charged surface is subjected to an image exposure by image exposure means 3 constituting image information writing means and constituted for example of a projection exposure apparatus for an unrepresented original image or a scanning exposure apparatus with an imagewise modulated laser beam, whereby the charged potential in an exposed light portion is attenuated to form, on the surface of the photosensitive drum 1, an electrostatic latent image corresponding the exposed image information.

Such electrostatic latent image is rendered visible in succession, at a developing position N4, as a transferrable developer image (toner image or visible image) by a developing apparatus 4.

The toner image thus formed on the photosensitive drum 1 is transferred, at a transfer position N5, onto a transfer material (transfer paper) 5 by transfer means 5.

The transfer means in the present example is of contact transfer type utilizing a roller-shaped contact transfer charger 5 (hereinafter referred to as "transfer roller").

The transfer roller 5 is constituted for example of a metal core and an elastic layer of a medium resistance formed around such metal core, and is pressed to the photosensitive drum 1 under a predetermined pressure, against the elasticity of the elastic layer, thereby forming a transfer position (transfer nip portion) N5. It is rotated in a direction R5, same as the rotating direction of the photosensitive drum 1, and with a peripheral speed approximately same as that of the photosensitive drum 1.

A transfer material P is fed from a feeding unit 16, and is advanced to the transfer position N5 under a timing control by unrepresented registration rollers provided in front of the transfer position N5.

More specifically, the registration rollers advance the transfer material P in such a timing that a leading end of the transfer material P arrives at the transfer position N5 when a leading end of a toner image area formed on the surface of the rotating photosensitive drum 1 reaches the transfer position N5.

The transfer material P supplied to the transfer position N5 is pinched and conveyed, with a surface thereof in contact with the photosensitive drum 1, through the transfer position N5. Also during a period from the arrival of the leading end of the transfer material P at the transfer position N5 to the passing of the trailing end of the transfer material out of the transfer position N5, a predetermined transfer bias voltage of a positive polarity is applied to the metal core of the transfer roller 5 from an unrepresented transfer bias source.

In the course of pinched conveying of the transfer material P through the transfer position N5, the toner image on the photosensitive drum 1 is transferred in succession onto the transfer material P, by a function of a transferring electric field formed by the transfer roller 5 functioning as a contact transfer charger and by a pressure at the transfer position N5.

The transfer material P, after emerging from the transfer position N5, is separated from the surface of the photosensitive drum 1 and is conveyed to a fixing device 9 in which the transferred toner image is fixed as a permanent image on the surface of the transfer material P, whereupon a formed image (copy or print) is discharged.

After the separation of the transfer material P, the surface of the photosensitive drum 1 is cleaned by a cleaner 10 constituting cleaning means, for eliminating deposited contamination such as remaining toner and paper dust, and is repeatedly used for image formation.

As a developing apparatus 4 to be employed in such image forming apparatus, there has been proposed and commercialized a dry one-component developing apparatus in various types. An example is an apparatus utilizing an impression (contact) development. Such impression development, not requiring a magnetic material, has various advantages such as enabling to simplify and compactize the apparatus and enabling a color image formation with non-magnetic toners.

FIG. 10 shows a developing apparatus utilizing impression development.

In the impression development, since the development is executed by pressing or contacting a surface of a developer carrying member with an electrostatic latent image, it is necessary to employ, as the developer carrying member, a developing roller 101 having elasticity and conductivity.

For achieving image formation with a predetermined density by the developing roller 101, a certain surface roughness has been required in order to carry a large amount of the developer. For obtaining a predetermined surface roughness, a layer containing insulating particles formed by an urethane resin or an acrylic resin is provided as an outermost layer 101*b*, but a resin layer is provided on the insulating particles in order to regulate the surface roughness, so that the insulating particles do not protrude on the surface of the developing roller 101.

Also for obtaining a known developing electrode effect or a known bias effect at the development, it is possible to form a conductive layer in the outermost layer 101*b* of the developing roller or in the vicinity of the outermost layer 101*b*, and to apply a bias voltage if necessary.

Also a charge provision to a developer (toner) 105 is achieved by a frictional charging between the developing roller 101 and a developing blade 102 which regulates a toner amount on the surface thereof thereby forming a toner layer.

However, in the impression development employing the aforementioned developing roller 101, there is experienced a drawback of a decrease of frictional charging ability on the toner when the toner is deteriorated with an increase in the number of image formations, thereby resulting in a fog formed by toner deposition in a solid white background.

SUMMARY OF THE INVENTION

An object of the present invention is to provide a developer carrying member and a developing apparatus capable of obtaining an appropriate triboelectricity on the developer.

Another object of the present invention is to provide a developer carrying member and a developing apparatus advantageously employable in a contact developing method.

Still another object of the present invention is to provide a developer carrying member and a developing apparatus capable of preventing fog generation.

Still another object of the present invention is to provide a developer carrying member and a developing apparatus free from a decrease in a frictional charging property on the developer even when the toner is deteriorated with an increase in the number of image formations.

Still other objects of the present invention, and the features thereof, will become fully apparent from the following detailed description which is to be taken in conjunction with the accompanying drawings.

DETAILED DESCRIPTION OF THE PREFERRED EMBODIMENTS

In the following, a developing apparatus and a developer carrying member of the present invention will be explained in details with reference to the accompanying drawings.

Embodiment 1

Figure 1:
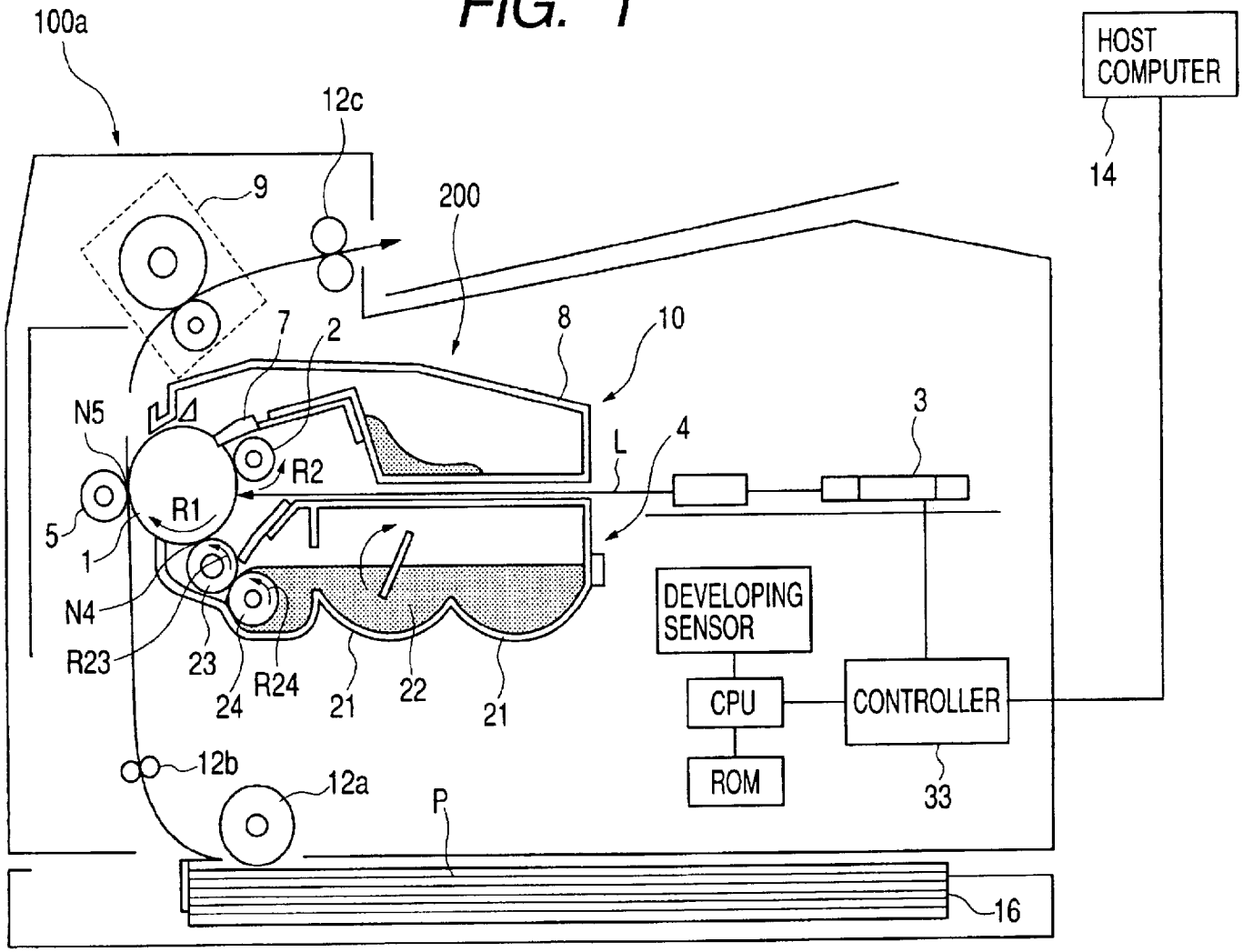
FIG. 1 is a schematic view showing an example of the configuration of an image forming apparatus embodying the present invention.

FIG. 1 is a schematic cross-sectional view of an embodiment of an image forming apparatus in which a developer carrying member and a developing apparatus of the invention is employable. An image forming apparatus 100*a* of the present embodiment is a laser beam printer for forming an image on a transfer material P such as a recording paper or an OHP sheet by an electrophotographic process according to image information. In the image forming apparatus 100*a* of the present embodiment, a process cartridge 200 is detachably mounted as will be explained in more details later.

The image forming apparatus 100*a* is used by connecting with a host apparatus 14 such as a personal computer. A controller unit 33 process a print demand signal and image data from the host apparatus 14 and controls a scanner 3 constituting exposure means, thereby forming an electrostatic latent image on a photosensitive drum 1 constituting an image bearing member rotated in a direction R1.

The photosensitive drum 1 is uniformly charged by a DC contact charging roller (charging roller) 2 which is a roller-shaped charging member in pressed contact with the photosensitive drum 1. The charging roller 2 is given a predetermined fixed DC voltage as a charging bias, and uniformly charges the surface of the photosensitive drum 1 in a negative polarity. The charging roller 2 is rotated in a direction R2 by a rotation of the photosensitive drum 1. The charging roller 2 is contacted over an approximately entire area in a longitudinal direction (perpendicular to a conveying direction of the transfer material P) of the photosensitive drum 1.

The uniformly charged photosensitive drum 1 is exposed to a laser light L from the scanner 3 constituting the exposure means, thereby forming an electrostatic latent image on the surface. The scanner 3 is provided with a laser light source, a polygon mirror, a lens system etc. (these not shown), and can scan exposure the photosensitive drum 1 under the control of the controller unit 33.

Thereafter, the electrostatic latent image is subjected to a supply of a developer by a developing apparatus 4 and is rendered visible as a toner image. The developing apparatus 4 has a developing container 21 containing a negatively chargeable non-magnetic toner (toner) 22 as a one-component developer. In the present embodiment, the toner 22 was composed of an approximately spherical toner of a weight-averaged particle size of about 7 $\mu$m in order to achieve a smaller particle size and a lower melting point, and to improve a transfer efficiency.

A part of the developing container 21 opposed to the photosensitive drum 1 has an aperture substantially over the entire longitudinal direction of the photosensitive drum 1, and a developing roller 23 constituting a roller-shaped developer carrying member (developing means) is provided in such aperture. The developing roller 23 is pressed, with a predetermined intrusion amount, to the photosensitive drum 1 which is positioned at upper left of the developing apparatus 4 in the drawing, and is rotated in a direction R23.

At lower right of the developing roller 23, an elastic roller 24 is contacted in order to supply the developing roller 23 with the developer (toner) 23 and to peel off unused toner from the developing roller 23. The elastic roller 24 is supported rotatably in the developing container 21. In consideration of the toner supply to the developing roller 23 and the peeling off of the unused toner, the elastic roller 24 is constituted of a rubber sponge roller, and is rotated in a direction R24 which is same as the rotating direction of the developing roller 23.

Also the developing apparatus 4 is provided with a developing blade 25 as a developer layer thickness regulating member for regulating the amount of the toner carried by the developing roller 23. The developing blade 25 is constituted of an elastic metal plate of phosphor bronze, and is so positioned that a vicinity of a free front end thereof forms a planar contact with the external periphery of the developing roller 23. The toner carried on the developing roller 23 by a friction with the elastic roller 24 is given a charge by a frictional charging in passing a contact portion with the developing blade 25, and also is regulated into a thin layer. The toner layer carried on the developing roller 23 is regulated, by the developing blade 25, into a thickness of 6 to 20 $\mu$m.

In the developing apparatus 4 of such configuration, the developing roller 23 is given a DC voltage fixed at a predetermined value, as a developing bias. In this manner, in the present embodiment, toner is supplied to the uniformly charged surface of the photosensitive drum 1 to develop an exposed portion, where the negative charge is attenuated, by reversal development thereby forming a developer image (toner image).

On the other hand, a transfer material P is separated and supplied from a transfer material container unit 16 by a feed roller 12*a* etc., and is once stopped at registration rollers 12*b*. The registration rollers 12*b* advances the transfer material P to an opposed portion (transfer position) N5 of the transfer roller 5 constituting the transfer means and the photosensitive drum 1, synchronizing a recording position on the transfer material P and a timing of toner image formation on the photosensitive drum 1.

Thus the visible toner image on the photosensitive drum 1 is transferred onto the transfer material P by a function of the transfer roller 5. The transfer material P bearing the transferred toner image is conveyed to a fixing unit 9. The unfixed toner image on the transfer material P is permanently fixed by heat and pressure onto the transfer material P. Thereafter the transfer material P is discharged to the exterior of the apparatus by discharge rollers 12*c* etc.

Also residual toner, not transferred but remaining on the photosensitive drum 1, is cleaned by cleaning means (cleaner) 10. The cleaner 10 scrapes off the residual toner by a cleaning blade constituting a cleaning member from the photosensitive drum 1, and stores it in a used toner container 8. The cleaned photosensitive drum 1 is used again for image formation.

In the present embodiment, the image forming apparatus 100*a* is constructed as a process cartridge type, in which the image bearing member including the electrophotographic photosensitive member or the photosensitive drum 1 and process means acting on the image bearing member 1 are formed into a cartridge 200, which is detachably mounted on a main body 100*a* of the apparatus.

The process means includes charging means which is a charging roller 2 for charging the electrophotographic photosensitive member, developing means which is a developing apparatus for supplying the electrophotographic photosensitive member with developer, and cleaning means which is a cleaner 10 for cleaning the electrophotographic photosensitive member.

More specifically, the process cartridge integrally includes the charging means, the developing means and the cleaning means and the image bearing member for forming an electrostatic latent image on the surface thereof as a cartridge which is rendered detachably mountable in the main body of the image forming apparatus, or integrally includes at least one of the charging means, the developing means and the cleaning means, and the image bearing member as a cartridge, which is rendered detachably mountable in the main body of the image forming apparatus, or integrally includes at least the developing means and the image bearing member as a cartridge and is which is rendered detachably mountable in the main body of the image forming apparatus.

In the present embodiment, the photosensitive drum 1, the charging roller 2, the developing apparatus 4 and the cleaner 4 are integrally constructed as a process cartridge 200, which is rendered detachably mountable in the main body 100*a* of the image forming apparatus. The process cartridge 200 is detachably mounted on the main body 100*a* of the apparatus through unrepresented mounting means provided therein.

Such process cartridge 200 allows, particularly in an image forming apparatus of electrophotographic type, to easily replace components such as process means or an electrophotographic photosensitive member. Therefore the maintenance property of the image forming apparatus is significantly improved. Also a high image quality can be constantly maintained by the replacement of the cartridge 200, thus replacing important components of the electrophotographic process to new ones.

In the following, there will be given a detailed explanation on the features of the present invention.

As explained in the conventional technology, a conventional developing roller has an outermost layer including insulating particles formed by an urethane resin or an acrylic resin, but a resin layer is formed on the insulating particles in order to regulate the surface roughness so that the insulating particles do not protrude from the surface of the developing roller. Consequently, when the toner is deteriorated with an increase in the number of image formations, the frictional charging ability for the toner is lowered thereby resulting in a fog caused by toner deposition on a solid white background.

In the present embodiment, the insulating particles are made to protrude with a suitable area on a surface of the developing roller opposed to the photosensitive drum and constituting the developing portion, namely on the peripheral surface of the developing roller, thereby preventing a decrease of the frictional charging ability on the toner in a situation where the toner is deteriorated with an increase in the number of image formations.

At first there will be explained a method of defining a protruding amount of the insulating particles on the surface of the developing roller.

Figure 2:
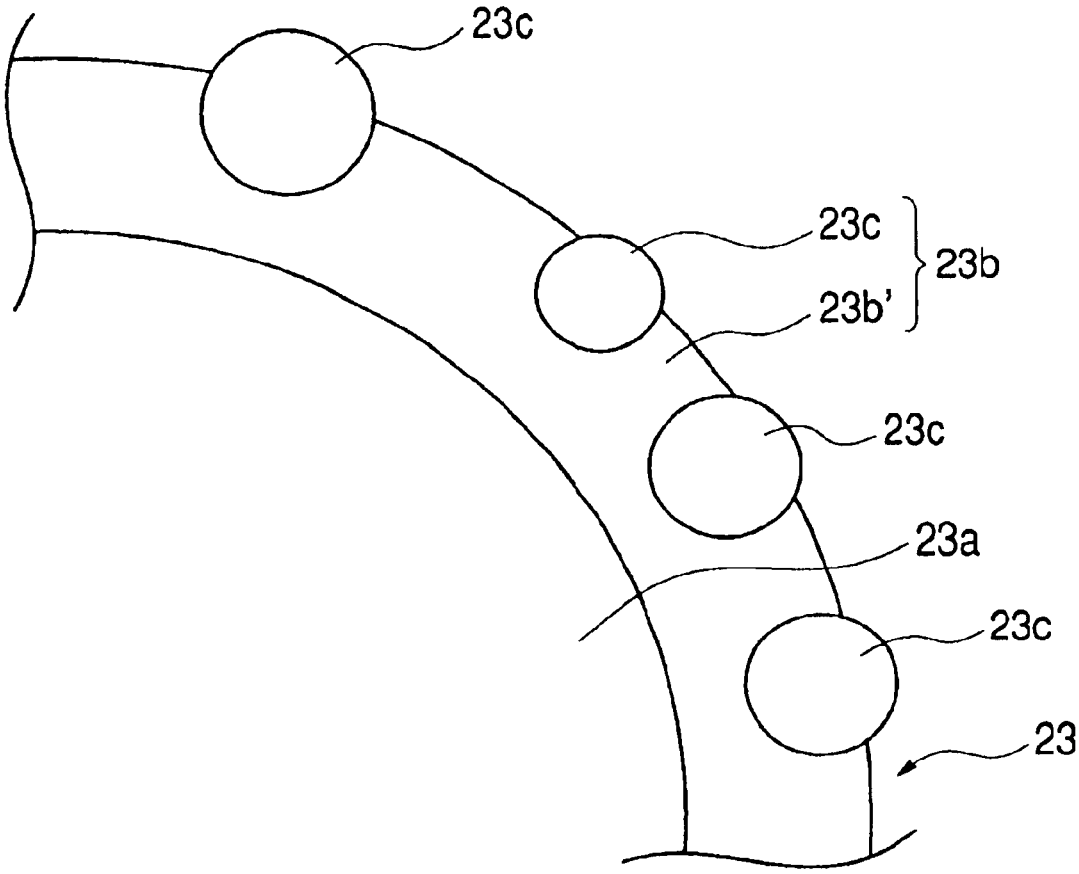
FIG. 2 is a partial cross-sectional view showing an example of a developer carrying member of the present invention.

In the present embodiment, as shown in FIG. 2, there was employed a developing roller 23 having an elastic layer formed by an elastic silicone rubber as a base layer 23*a*, and an urethane resin 23*b*' formed by a resinous member containing urethane particles 23*c* as an outermost layer 23*b* coated on the surface.

In the present embodiment, a surface roughness of the developing roller 23 is controlled at a ten-point averaged surface roughness Rz of 6 to 9 $\mu$m in Japanese Industrial Standard (JIS) to obtain an appropriate toner coat amount on the developing roller 23, and the outermost layer 23*b* is given a thickness of 5 to 30 $\mu$m and the urethane particles 23*c* are given a particle size of 10 to 30 $\mu$m for maintaining Rz within a range of 6 to 9 $\mu$m.

Figure 3:
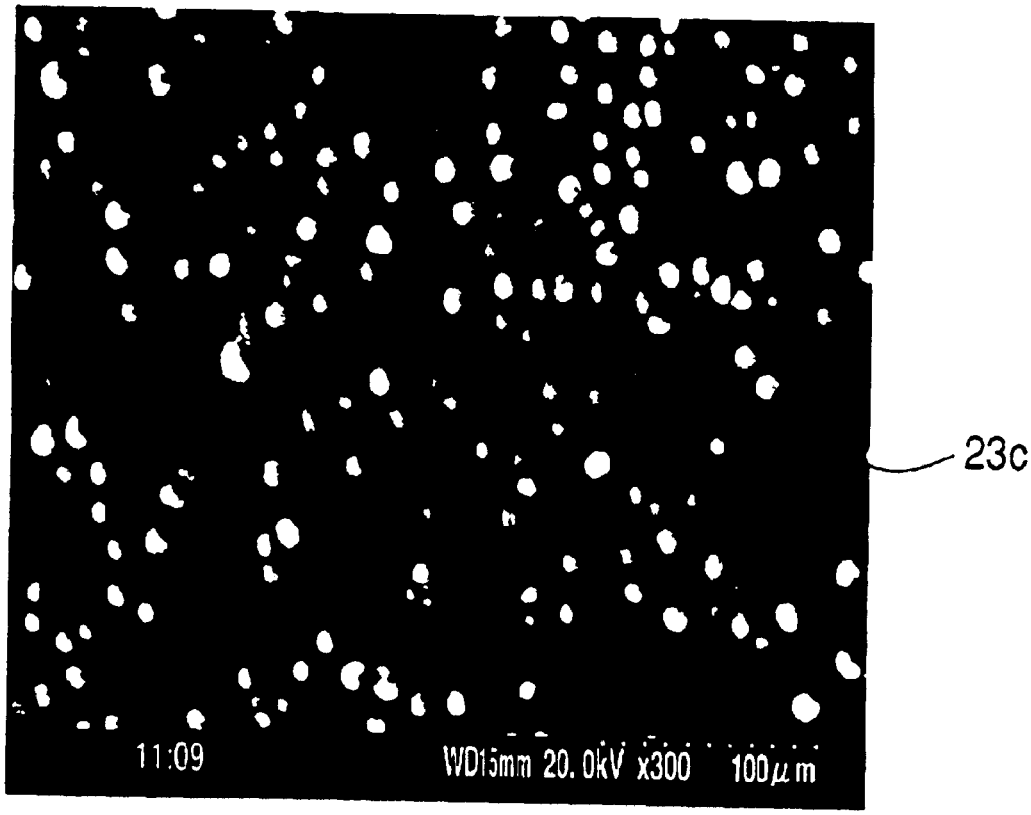
FIG. 3 is a SEM photograph showing an example of a peripheral surface of a developer carrying member of the present invention.

In the developing roller 23 employed in the present embodiment, as shown in FIG. 2, the insulating particles 23*c* protrude from the surface of the outermost layer 23*b*, and there is calculated an area proportion of the particles 23*c* protruding on the surface shown in a SEM photograph shown in FIG. 3 with respect to the surface area of the periphery of the developing roller 23, opposed to the photosensitive drum 1. Calculation is made by measuring, on a peripheral area of 0.25×0.25 mm of the developing roller 23, each protruding portion of the particle 23*c* as an oval area in a 1000 times magnified SEM photograph, summing all the measured areas, then calculating a proportion as an area rate to the peripheral area of 0.25×0.25 mm of the developing roller 23, and taking an average of such measurements made in 3 points in the longitudinal direction, thereby obtaining a protruding amount of the particles 23*c* from the surface of the developing roller 23.

Figure 4:
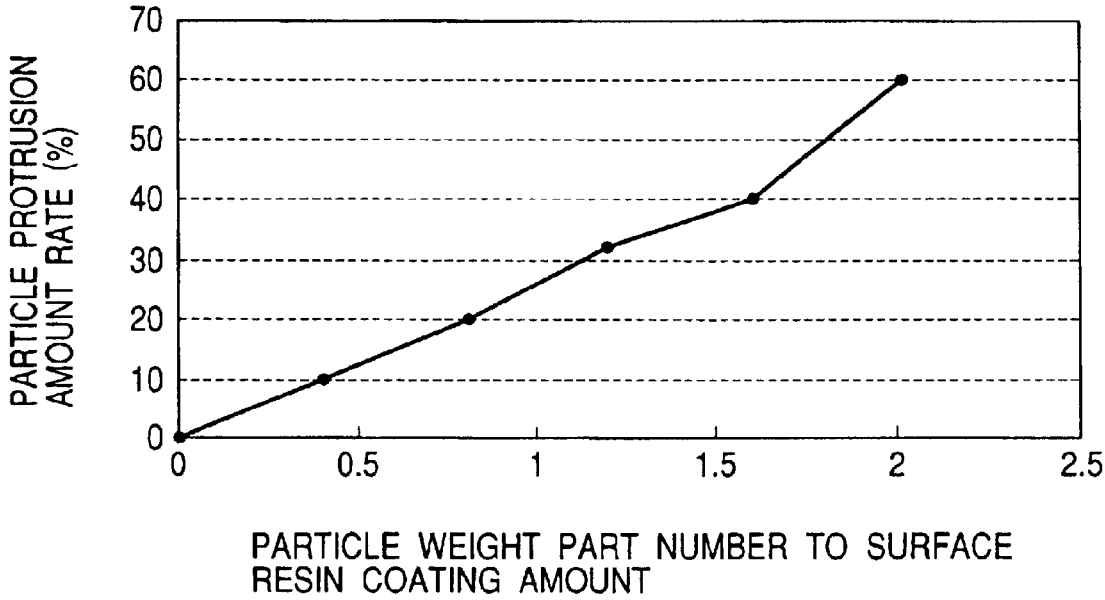
FIG. 4 is a chart showing a relationship of a proportion of protruding insulating particles of the present invention and a coating amount of a surface resin layer as a function of a number of parts by weight of the particles.

The particle protruding rate (%) obtained by the above-described calculation can be regulated at a desired value, based on a relationship shown in FIG. 4 and indicated as a function of number of parts by weight of the urethane particles 23*c* with respect to the urethane surface resin 23*b*' constituting the outermost layer 23*b*, by suitably varying the amounts of both materials.

Thus, it is possible to estimate the rate of the surfacially protruding particles 23*c* from the number of parts by weight of the particles 23*c* with respect to the surface resin coat amount 23*b*' based on FIG. 4, and, in the present embodiment, a developing roller 23 was prepared by employing a part by weight of the particles with respect to the surface resin coating amount 23*b*' to obtain an area rate of the protruding particles 23*c* of 15% or higher, whereby the frictional charging ability to the toner was not deteriorated even when the toner was deteriorated with an increase in the number of image formations and a high quality image without fog could be obtained. In order to appropriately expose the particles in the surface area of the developing roller, the sizes of the particles are preferably made larger than a thickness of the surface resin layer of the developing roller.

In the developing roller 23 of the present invention, an area rate of the surfacially protruding particles of 70% results in an insufficient dispersibility of the particles 23*c* and an excessively high surface resistance, thereby resulting an image defect such as a developing ghost, so that 60% is a limit for the area rate of the surfacially protruding particles 23*c*.

The effect of the developing roller of the present invention was clarified in a following experimental example 1 in comparison with a conventional developing roller.

EXPERIMENTAL EXAMPLE 1

Figure 5A:
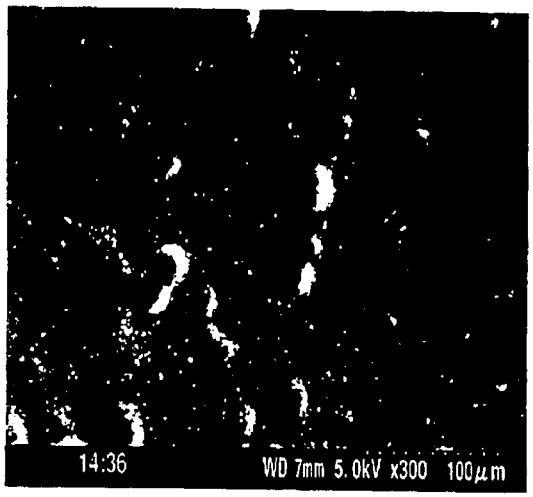
FIGS. 5A, 5B and 5C are SEM photographs showing a peripheral surface of a developer carrying member employed in an experiment 1.
Figure 5B:
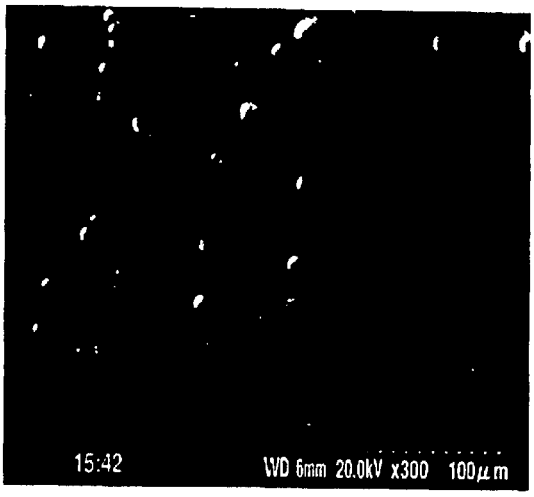
Figure 5C:
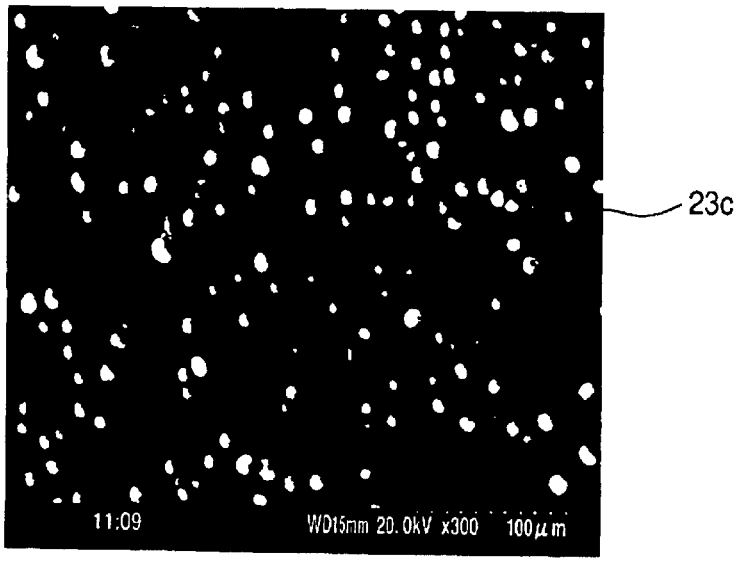

There were prepared five developing rollers, namely a conventional developing roller A provided with a base layer 23*a* of silicone rubber and an outermost layer 23*b* coated with an urethane resin 23*b*' in such a manner that the insulating urethane particles 23*c* did not protrude from the surface, and developing rollers B, C, D and E in which the urethane particles 23*c* protruded from the surface. FIGS. 5A, 5B and 5C respectively show SEM photographs of the surfaces of the developing rollers A, B and C. For the developing rollers D and E, SEM photographs are omitted as they were similar to the developing roller C.

The surface particle protrusion rate (%) and the surface roughness Rz (μm) of the developing rollers A, B, C, D and E, calculated as explained in the foregoing, are shown in Table 1.

TABLE 1

| Developing roller | Particle protrusion rate (%) | Surface roughness Rz (μ 1 m) |
|---|---|---|
| A | 0 | 7.5 |
| B | 10 | 7.9 |
| C | 15 | 8.1 |
| E | 30 | 8.3 |
| E | 60 | 8.5 |

Also the frictional charging ability of these developing rollers A, B, C, D and E was investigated by executing a frictional charging with a metal drum, and a potential difference to the metal drum, a current and an electric power were measured. Obtained results are shown in Table 2.

TABLE 2

| Developing roller | Potential difference (−V) | Current ($-10^{-6}$ A) | Electric power ($-10^{-7}$ W) |
|---|---|---|---|
| A | 0.15 | 0.66 | 1.01 |
| B | 0.35 | 3.23 | 11.42 |
| C | 0.69 | 4.47 | 17.01 |
| D | 0.73 | 4.2 | 18.1 |
| E | 0.78 | 4.32 | 17.7 |

As shown in the foregoing table, the developing rollers A, B, C, D and E showed a higher frictional charging ability to the metal drum with a surface protruding rate of the urethane particles which are positive insulating particles 23*c*.

Figure 6A:
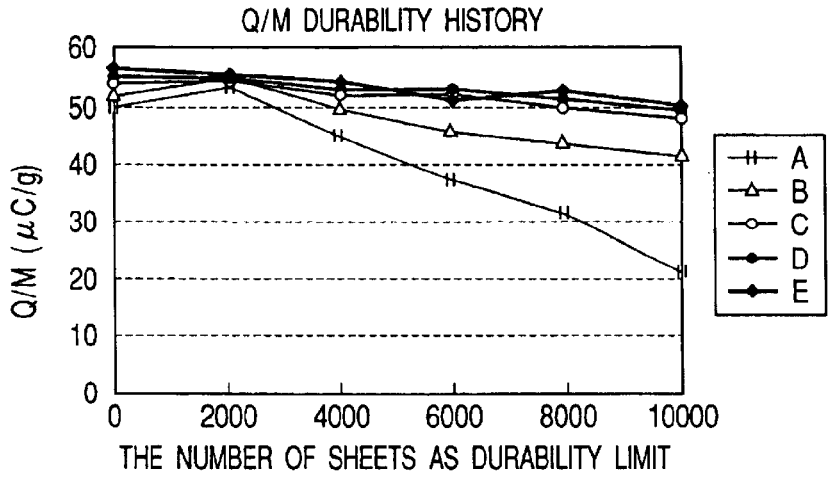
FIGS. 6A, 6B and 6C are charts showing experimental results of the experiment 1.
Figure 6B:
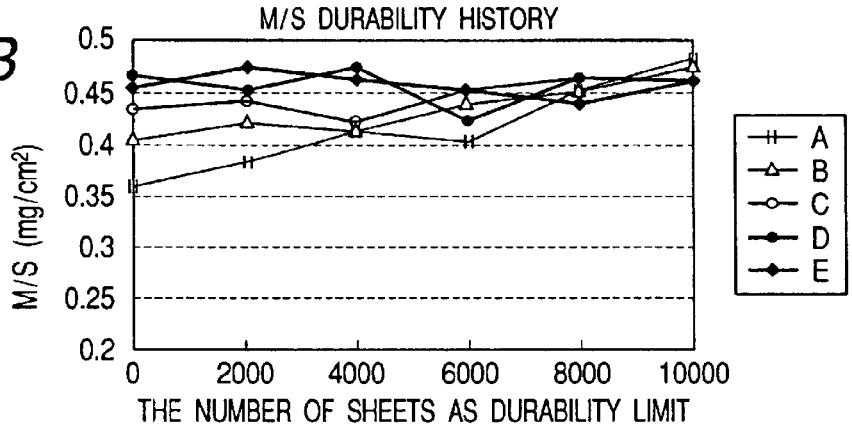
Figure 6C:
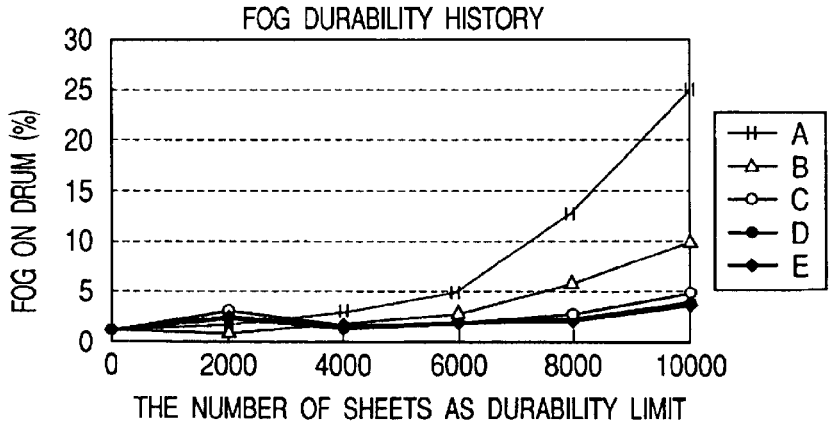
Figure 7:
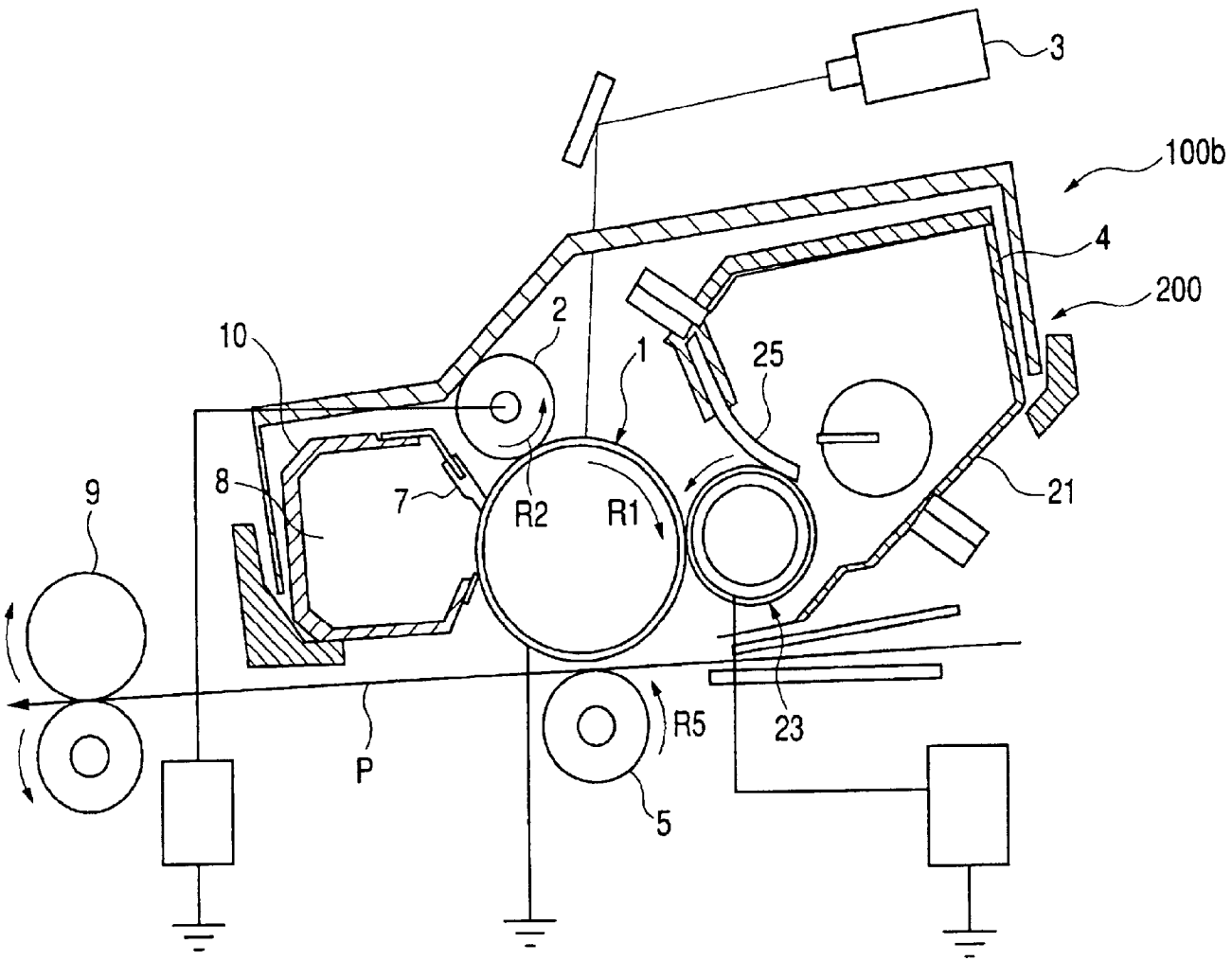
FIG. 7 is a schematic view showing another configuration of the image forming apparatus of the present invention.

FIGS. 6A, 6B and 6C show, as histories of a durability printout test of 10,000 sheets, Q/M (μC/g) of toner on the developing roller 23 (FIG. 6A), a toner coating amount M/S (mg/cm$^2$) on the developing roller (FIG. 6B), and an on-drug fog (%) represented by a fog area with respect to the surface area of the metal drum (FIG. 6C).

As shown in FIGS. 6B and 6C, the durability test history of the toner coat amount M/S on the developing roller 23 shows little differences between the developing rollers, so that the increase of the fog with the increase in the number of image formations is considered to result from a decrease of Q/M on the developing roller based on the loss of the frictional charging property on the deteriorated toner, as shown in FIG. 6A.

Also the fog increases as the frictional charging property decreases, and the developing roller A or B with a low frictional charging ability showed a fog of 10 to 25%, while, in the developing rollers C, D and E with a high frictional charging ability Q/M of about 50 μC/g, the fog could be suppressed to 5% or less.

Based on these results, it was found that the developing roller C, D or E in which the urethane particles 23*c* protruded in an area proportion of 15% or more on the surface of the developing roller did not show a decrease of the frictional charging ability to the deteriorated toner, also could suppress the decrease of Q/M on the developing roller in the durability test and scarcely showed an increase of the fog, in comparison with the developing roller B with a surfacially protruding rate of the urethane particles of 10% or the conventional developing roller A surfacially coated with the urethane resin in such a manner that the urethane particles 23*c* did not protrude on the surface.

This indicates the effect of the urethane particles, which are positive insulating particles, for improving the frictional charging ability to the deteriorated toner, and, in case the surface roughness Rz is 6 to 9 μm, the rate of the surfacially protruding urethane particles is preferably higher for improving the frictional charging ability to the deteriorated toner, and is preferably at least 15% or higher based on the results of this example.

Also as explained in the foregoing, an area rate of the surfacially protruding particles of 70% results in an insufficient dispersibility of the particles 23*c* and an excessively high surface resistance, thereby resulting an image defect such as a developing ghost, so that 60% is a limit for the area rate of the surfacially protruding particles 23*c*. In the present example, the developing rollers had a surface resistance of $10^4$ to $10^7$ Ω to provide a developing ghost of an acceptable level, but, at an area rate of the surfacially protruding particles of 70%, the surface resistance increased to $5\times10^7$ Ω at which the ghost resistance was not acceptable.

According to the present example, as explained in the foregoing, it is possible to provide an image forming apparatus in which the frictional charging ability on the toner is not deteriorated even when the toner is deteriorated with an increase in the number of image formations, whereby the fog does not increase, by employing a developing roller in which the insulating particles such as urethane particles protrude on the surface with a summed area rate of the protruding portions of 15 to 60% with respect to area of the outermost layer.

Also in the present example, there is employed a contact development method and the developer layer carried on the developing roller is regulated by the developing blade to a thin layer of 6 to 20 μm. Since such thin layer is mostly deposited at the developing nip corresponding to the electrostatic image on the image bearing member, the developer in such thin layer requires an appropriate charge amount both on a surface side and a rear side of the thin layer. Therefore, in the developer layer as thin as in the present example, it is preferable that the particles has an exposed area rate of 15 to 60% with respect to the surface area of the developing roller.

The present example employs urethane particles as the insulating particles protruding from the surface of the developing roller, but the particles are not limited to such example but can also be formed for example by particles of polyamide resin or acrylic resin for obtaining similar results.

Also the resin member constituting the outermost layer is not limited to urethane resin but can also be composed of a polyamide resin or an acryl-denatured silicone resin, and the elastic member constituting the elastic base layer is not limited to silicone rubber but can also be composed of butadiene rubber or the like.

Also the present invention is applicable also to a case where the image forming apparatus is not constructed as a process cartridge system, with similar effects as in the present example.

In the developing roller explained in the foregoing, in case the employed developer is negatively chargeable, there are employed the insulating particles of a positively chargeable property, and in case the developer is positively chargeable and the insulating particles are of negatively chargeable property, the frictional charging ability to the photosensitive drum can be advantageously maintained high.

Also as to the outermost layer the elastic layer, the outermost layer can be formed for example by urethane resin, polyamide resin or acryl-denatured silicone resin, while the elastic layer can be formed by silicone rubber or butadiene rubber.

Furthermore, the developing roller preferably contains a conductive material such as carbon so as to have an electrical resistance of $10^4$ to $10^8$ Ω.

This is for the following reason. In case the resistance is about $10^9$ Ω or higher in an ordinary environment, the conductivity tends to fluctuate by a change in the temperature in the humidity, because the concentration of the conductive particles dispersed in the main component for providing the conductivity is low. For this reason the resistance is susceptible to temperature and humidity and may change 10 or 100 times by an environmental change, and a resistance of about $10^9$ Ω in the ordinary environment may become about $10^8$ Ω in a high humidity environment or about $10^{10}$ Ω in a low humidity environment.

Therefore an upper limit of the resistance of the developing roller 23 is about $10^8$ Ω. Also a lower limit of the resistance of the developing roller 23 is determined by a value capable of preventing a detrimental influence on the developing roller 23 by a current flow on the photosensitive drum 1, and a resistance of $10^4$ Ω of higher is acceptable.

Therefore, the outermost layer and the elastic layer of the developing roller 23*c* preferably has a resistance of about $10^4$ to $10^8$ Ω.

Also as a conductive material, there can also be employed an ionic conductive material, a conductive resin or a resin in which conductive particles are dispersed.

EXAMPLE 2

In the following there will be explained another example of the image forming apparatus of the present invention.

In the image forming apparatus 100*a* explained in the example 1, there is employed a developing method of pressing the developing roller 23 serving as the developing means with a predetermined intrusion amount to the photosensitive drum 1, but the present example shows an image forming apparatus 100*b* executing a jumping development in which a developing roller 23 is maintained in non-contact with the photosensitive drum 1 for developing the latent image thereon.

Also in the present example, there is provided a process cartridge 200 integrating a developing apparatus 4, a photosensitive drum 1, a charging roller 2 and cleaning means 10.

Therefore, all the configurations of the developing apparatus explained in the example 1 are similarly applicable to the process cartridge of the present example. Therefore, the explanation in the example 1 on such configurations and functions thereof is likewise applicable to the present example.

EXAMPLE 3

Figure 8:
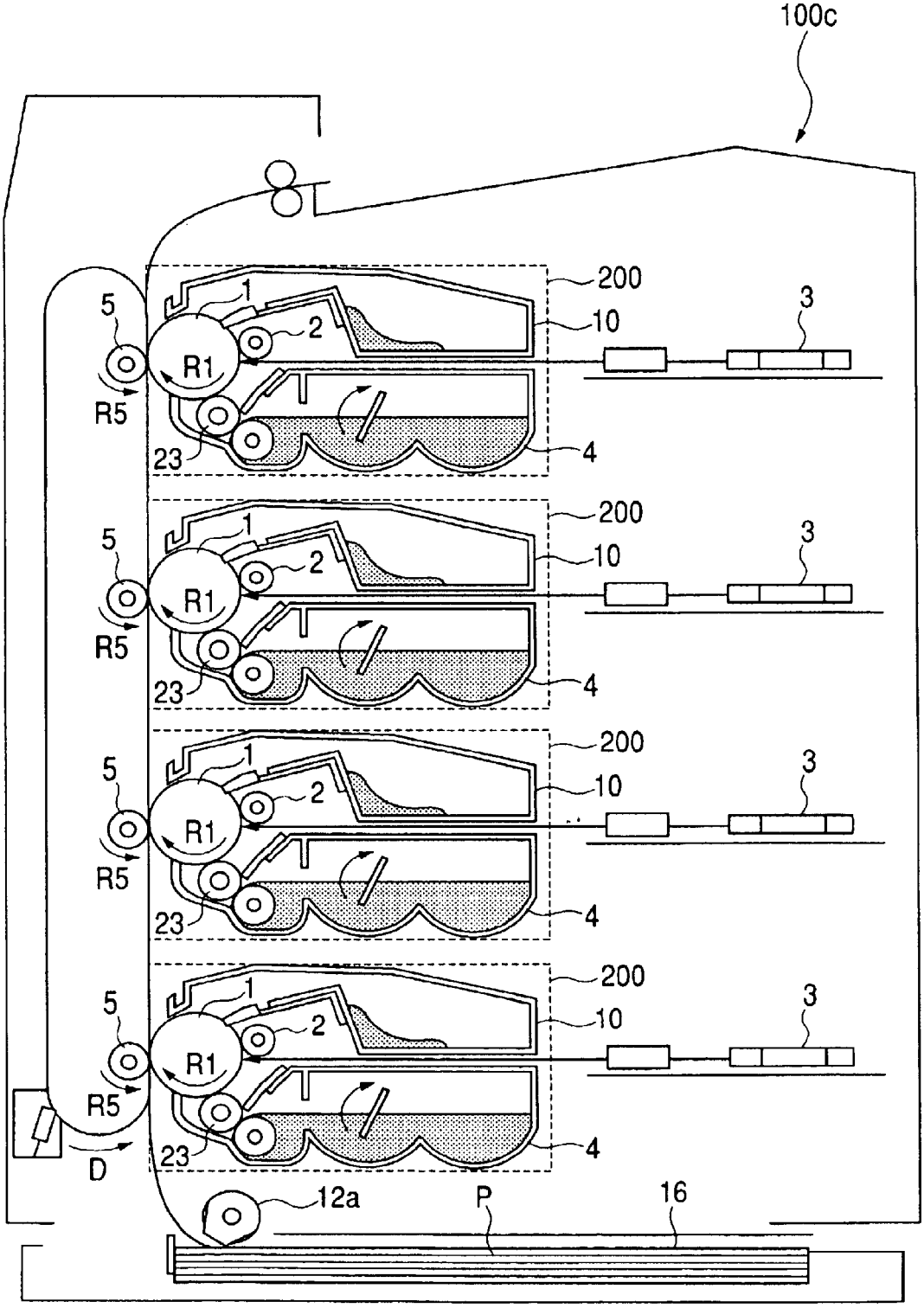
FIG. 8 is a schematic view showing another configuration of the image forming apparatus of the present invention.
Figure 9:
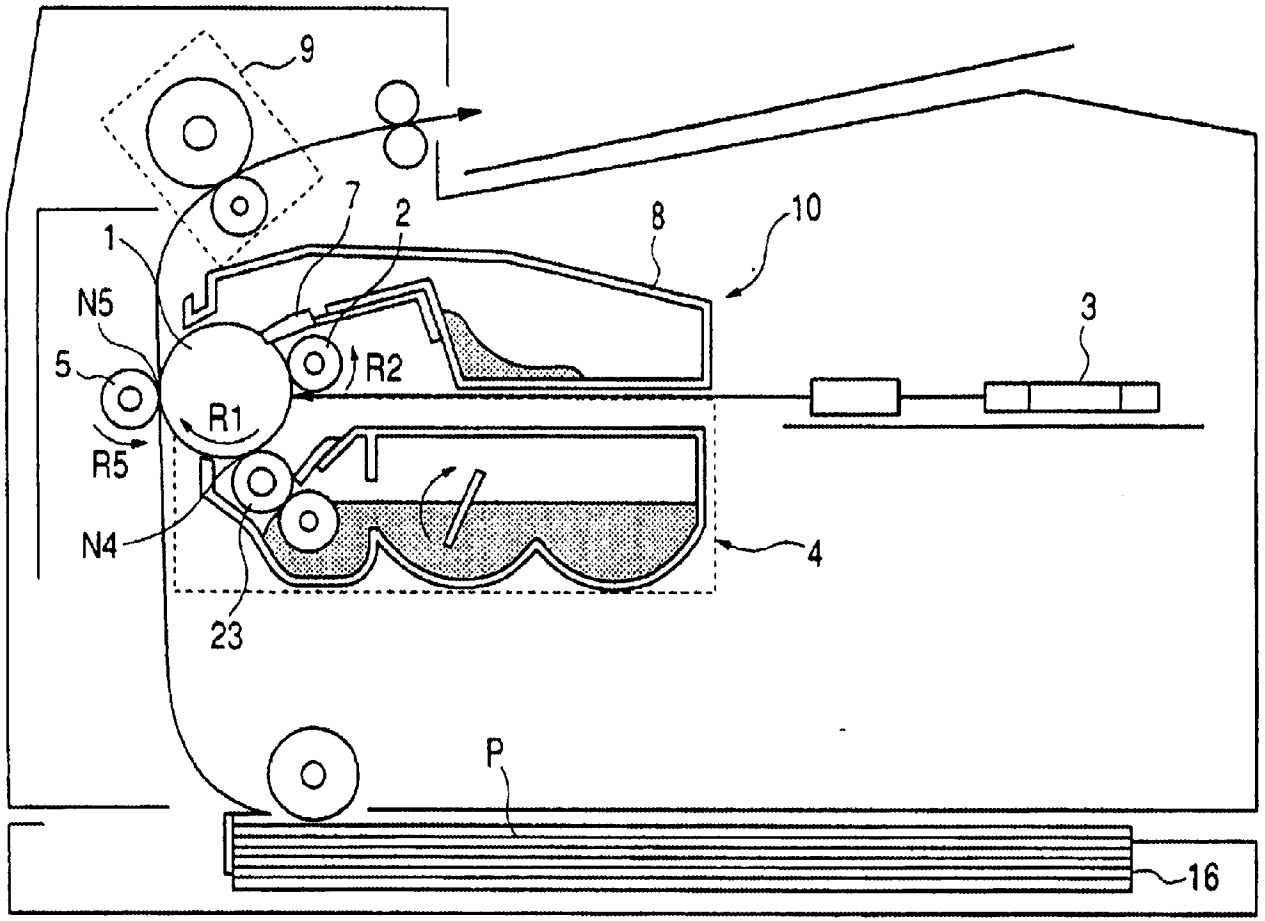
FIG. 9 PRIOR ART
FIG. 9 is a schematic view showing a configuration of a conventional image forming apparatus.
Figure 10:
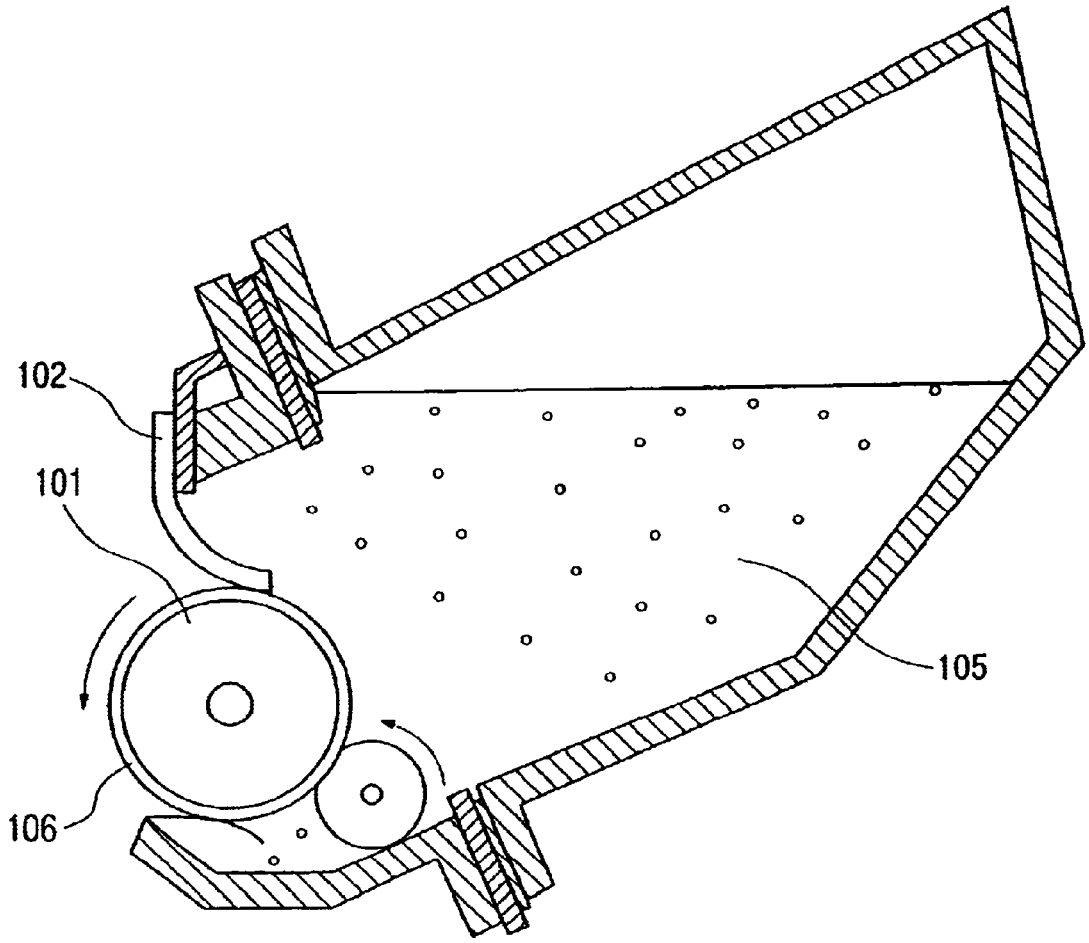
FIG. 10 PRIOR ART
FIG. 10 is a cross-sectional view showing an example of a conventional developing apparatus.

In contrast to the image forming apparatus 100*a* explained in the example 1, in case an image forming apparatus 100*c* is an in-line full-color laser beam printer in which four process cartridges 200 containing toners of respectively different colors are vertically arranged in the developing apparatus 4 as shown in FIG. 8, it is possible, by applying the operations of the examples 1 and 2, to provide a color image forming apparatus capable of forming a full-color image without the decrease of the frictional charging property to the toner even in case of toner deterioration with an increase in the number of image formations and without the fog generation. Such measure allows to obtain the effects similar to those in the examples 1 and 2 for each of the process cartridges 200 of four colors.

Though the present example employs an in-line full-color laser beam printer, but similar effects can also be obtained in a full-color laser beam printer of rotary type.

Also the experiment shown as Experimental Example 1, applied to the in-line full-color laser beam printer of the present example, provided similar results.

The configurations shown in Examples 1 to 3 allow to provide a developer carrying member not showing a decrease in the frictional charging ability on the toner even in case of a toner deterioration resulting from an increase in the number of image formations and not showing a fog, and a developing apparatus, a process cartridge and an image forming apparatus provided with such developer carrying member.

In the foregoing description of the image forming apparatus, a dimension, a material, a shape, a relative position etc. of components are not intended to limit the extent of the present invention unless specified otherwise.

As explained in the foregoing, the present examples provide a developing apparatus including a rotatable developer carrying member and adapted to develop an electrostatic latent image formed on an image bearing member, in which the developer carrying member has an outermost layer formed by dispersing particles in at least a resinous member, the particles have a positive charging property in case the developer is negatively chargeable and a negative charging property in case the developer is positively chargeable and the particles protrude from a surface of the developer carrying member opposed to the image bearing member in such a manner that an area rate of a summed area of the protruding portions to the surface area of the aforementioned opposed surface is within a range from 15 to 60%, and a process cartridge and an image forming apparatus provided with such developer carrying member and a developer carrying member provided therein, whereby the frictional charging property to the toner is not lowered even when the toner is deteriorated with an increase in the number of image formations thereby avoiding the fog formation and providing a satisfactory image.

What is claimed is:

1. A developer carrying member for carrying a developer for developing an electrostatic image formed on an image bearing member, comprising:

an elastic layer; and a surface layer provided on a surface of said developer carrying member and including a resin and particles;

wherein the particles have a property of being frictionally charged in a polarity opposite to a normal charging polarity of the developer, and the particles are exposed from said surface in an area rate within a range from 15 to 60% with respect to a surface area of said developer carrying member.

2. A developer carrying member according to claim 1, wherein said particles are dispersed in the resin.

3. A developer carrying member according to claim 1, wherein said developer carrying member includes a conductive material and has an electrical resistance within a range from $10^4$ to $10^8$ Ω.

4. A developer carrying member according to claim 1, wherein said surface layer has a thickness from 5 to 30 μm.

5. A developer carrying member according to claim 1 or 4, wherein said particles have a particle size within a range of 10 to 30 μm.

6. A developer carrying member according to claim 1, wherein said particles have a particle size larger than a thickness of said surface layer.

7. A developer carrying member according to claim 1, wherein said developer carrying member has a surface roughness in a ten-point averaged roughness Rz of 6 to 9 μm.

8. A developer carrying member according to claim 1, wherein said developer carrying member has a roller shape.

9. A developer carrying member according to claim 1, wherein a layer of said developer carried on said developer carrying member is regulated by a developer regulating member to a thickness of 6 to 20 μm.

10. A developing apparatus comprising:

a developer carrying member for carrying a developer for developing an electrostatic image formed on an image bearing member, the developer carrying member including:

an elastic layer; and a surface layer provided on a surface of said developer carrying member and including a resin and particles;

wherein the particles have a property of being frictionally charged in a polarity opposite to a normal charging polarity of said developer, and said particles are exposed from said surface in an area rate within a range from 15 to 60% with respect to a surface area of said developer carrying member.

11. A developing apparatus according to claim 10, wherein said particles are dispersed in said resin.

12. A developing apparatus according to claim 10, wherein said developer carrying member includes a conductive material and has an electrical resistance within a range from $10^4$ to $10^8$ Ω.

13. A developing apparatus according to claim 10, wherein said surface layer has a thickness from 5 to 30 μm.

14. A developing apparatus according to claim 10 or 13, wherein said particles have a particle size within a range of 10 to 30 μm.

15. A developing apparatus according to claim 10, wherein said particles have a particle size larger than a thickness of said surface layer.

16. A developing apparatus according to claim 10, wherein said developer carrying member has a surface roughness in a ten-point averaged roughness Rz of 6 to 9 μm.

17. A developing apparatus according to claim 10, wherein said developer carrying member has a roller shape.

18. A developing apparatus according to claim 10, wherein a layer of said developer carried on said developer carrying member is regulated by a developer regulating member to a thickness of 6 to 20 μm.

19. A developing apparatus according to claim 10, wherein said developing apparatus is provided in a process cartridge detachably mountable in a main body of an image forming apparatus.

20. A developing apparatus according to claim 10, wherein said developing apparatus is provided in an image forming apparatus including said image bearing member.

* * * * *